United States Patent [19]

Silaghi

[11] 4,134,179

[45] Jan. 16, 1979

[54] HINGE ASSEMBLY

[75] Inventor: Elmer W. Silaghi, Farmington, Mich.

[73] Assignee: Massey-Ferguson Inc., Detroit, Mich.

[21] Appl. No.: 811,408

[22] Filed: Jun. 29, 1977

[51] Int. Cl.[2] ..... E05D 1/00

[52] U.S. Cl. ..... 16/128.1; 180/69 C; 292/DIG. 14

[58] Field of Search ..... 16/128.1, 1 C, 180, 16/190; 180/69 R, 69 C; 296/76; 292/DIG. 14

[56] References Cited

U.S. PATENT DOCUMENTS

| | | | |
|---|---|---|---|
| 2,702,400 | 2/1955 | Marple | 16/128.1 X |
| 3,113,339 | 10/1963 | Krause | 16/128.1 |
| 3,195,172 | 7/1965 | Gionet | 16/128.1 |
| 3,749,437 | 7/1973 | Gley | 292/DIG. 14 |
| 3,754,613 | 8/1973 | Stephens et al. | 180/69 C |

FOREIGN PATENT DOCUMENTS

| | | | |
|---|---|---|---|
| 991463 | 5/1965 | United Kingdom | 292/DIG. 14 |

*Primary Examiner*—James Kee Chi
*Attorney, Agent, or Firm*—William R. Nolte

[57] ABSTRACT

A hinge assembly for the hood of a vehicle engine compartment which applies a spring force to counterbalance the weight of the hood so that the hood moves to an initial open position without the assistance of manual effort and can be moved from the initially open position through an arc greater than 90 degrees with a substantially constant manual force.

8 Claims, 6 Drawing Figures

HINGE ASSEMBLY

This invention relates to hinged structures and more particularly to a counterbalanced hinge assembly for use with the hoods of vehicles engine compartments.

On some vehicles such as large tractors and off-the-road equipment, hoods over the engine compartment become extremely large and heavy and difficult to open manually. Various forms of hinge arrangements have been employed but for the most part they become extremely complex and utilize a multitude of linkages and springs which are difficult to install and maintain in operative condition.

It therefore becomes an object of the invention to provide a counterbalanced hinge arrangement for vehicle hoods.

Another object of the invention is to provide a counterbalanced hinge arrangement for the hoods of vehicles in which the hood is urged to an initially open position and in which the manual effort required to swing the hood from the initially open position to a fully open position is at a relatively constant minimum throughout the entire range of movement of the hood.

Still another object of the invention is to provide a counterbalanced hinge arrangement in which a spring-assisted force remains relatively constant even though the load of the hood varies throughout its range of movement.

Still another object of the invention is to provide a hinge assembly which may be installed as a unit and which is concealed by the hood within the engine compartment when the hood is in its closed position.

A hinge assembly for a vehicle hood covering an engine compartment is provided in which a force-transmitting member associated with the hood exerts a force on a cam member connected to a wall of the engine compartment to counterbalance the weight of the hood so that the latter moves through an arc greater than 90 degrees from its closed to its fully open position. The net resultant force acting to open the hood is at a maximum upon initial opening of the hood so that no manual effort is required and so that the net force requires only a minimum and substantially constant manual effort to move the hood from its initially open position to its fully opened position.

These and other objects of the invention will be apparent from the following description and from the drawings in which.

Figure 1:
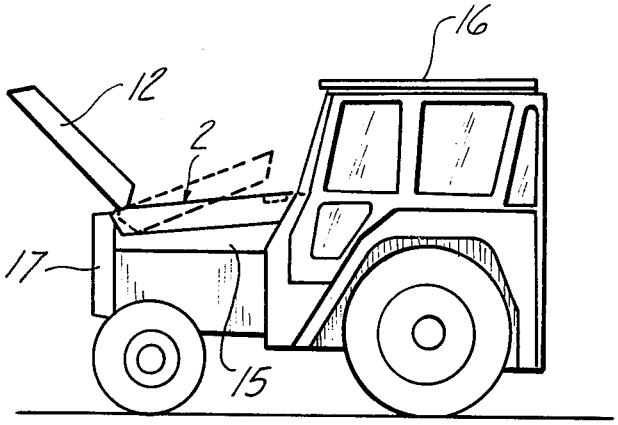
FIG. 1 is a side elevation of a vehicle with a hinged hood.

Referring to the drawings, the hinge structure of the present invention is designated at 10 and is used to support a hood 12 closing the opening 14 giving access to an engine compartment 15 of a vehicle 16. The forward end of the opening 14 is defined by cowl 17 extending over and rearwardly from a grill 18.

Figure 2:
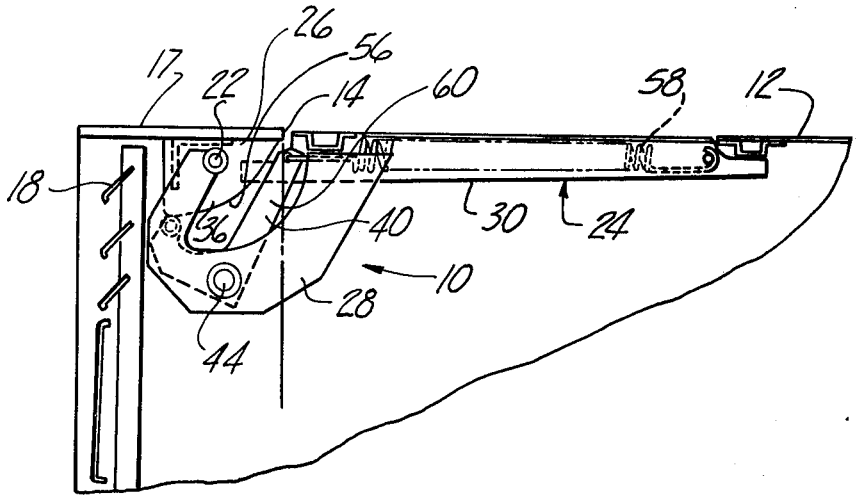
FIG. 2 is a side elevation of a hinge assembly as viewed from within an engine compartment.
Figure 3:
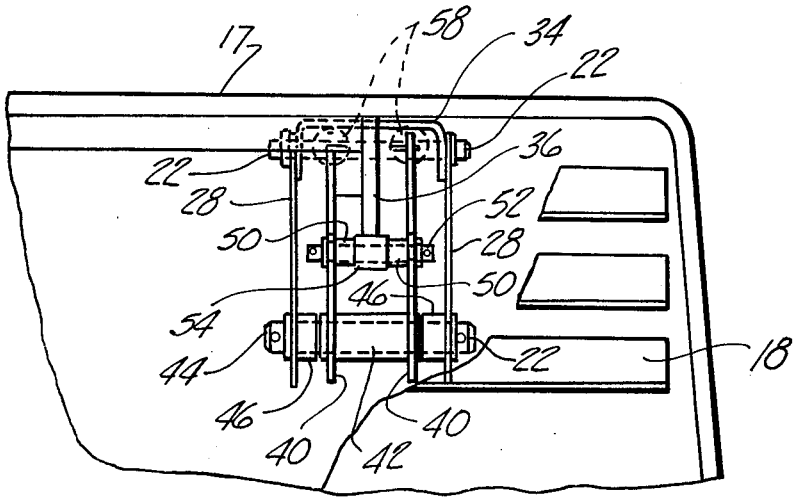
FIG. 3 is an end view of the hinge arrangement seen in FIG. 2 looking rearwardly of the vehicle.
Figure 5:
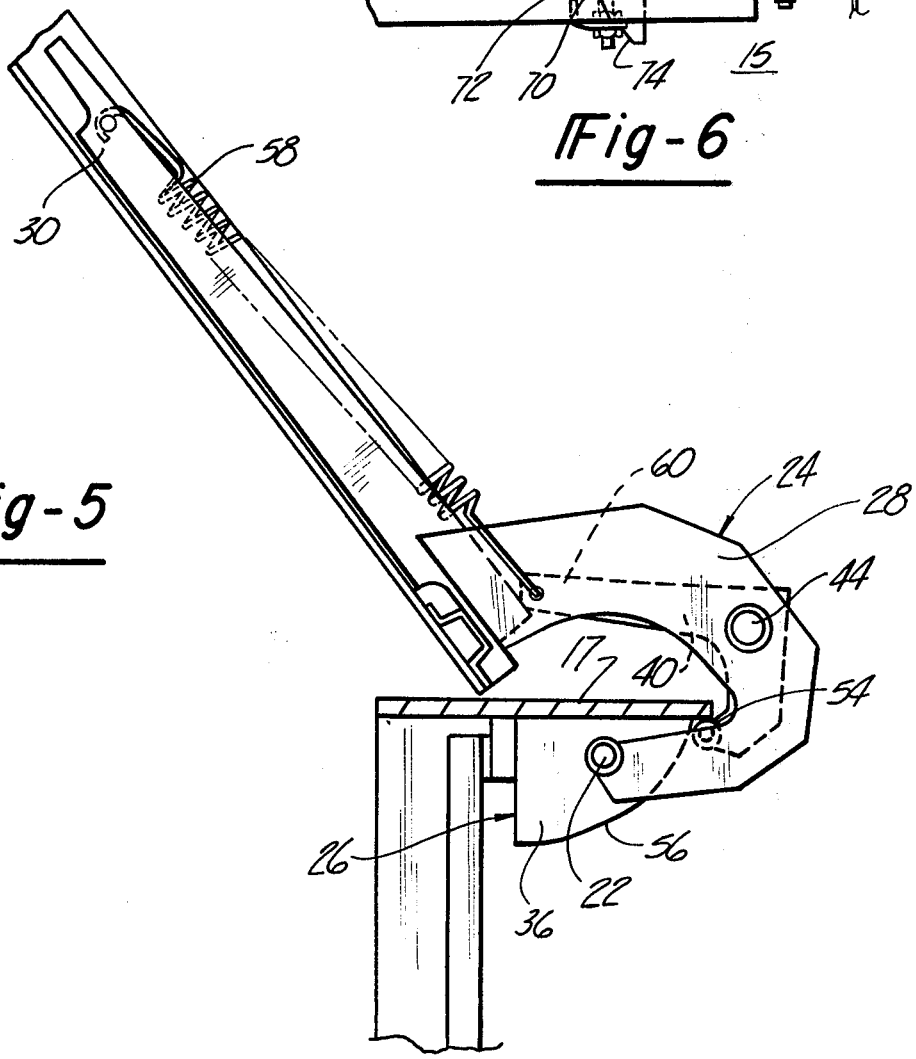
FIG. 5 is a view similar to FIG. 4 showing the hood in a fully opened position.

A pair of the hinge assemblies 10 are used to support the hood 12 for movement from the closed position relative to the opening 14 of the engine compartment 15 as seen in FIG. 2 to the open position seen in full line in FIG. 1 and also in FIG. 5. Opening and closing movement of the hood is about a horizontal hinge axis formed by a pin indicated at 22. Each of the pair of hinge assemblies 10 includes a hood hinge or subassembly 24 and an engine compartment hinge or subassembly 26 which are connected together by pin 22. The hinge assemblies 10 are identical with each other and only one will be referred to hereafter.

The hood hinge member 24 includes a pair of spaced C-shaped arm members 28 formed rigidly with a base member 30 which serves to maintain the arm members 28 in fixed, spaced-apart relationship to each other. The base member 30 extends generally longitudinally of the hood 12 and is adapted to be bolted to the latter. The forward end of the arm members 28 pivotally receive the pin 22 disposed on the horizontal hinge axis 22. The pins 22 are supported by a U-shaped bracket member 34 which is bolted or otherwise fastened to the cowl 17 of the engine compartment 15. The U-shaped bracket has a cam member 36 in the form of a plate extending generally longitudinally of the engine compartment at the underside of the cowl 17.

The spaced arm members 28 support a force-transmitting member which is in the form of a pair of parallel belt cranks 40 held in fixed, spaced-apart relationship on opposite ends of a tubular member 42. A pin 44 passes through the tubular member 42 and opposite ends are held in bosses 46 supported in axially aligned relationship on the inboard side of the arm members 28. One arm 48 of each of the bell cranks 40 is provided with a boss 50 which supports the opposite ends of a pin 52. The pin 52 rotatably supports a roller 54 which engages a cam surface 56 on the edge of the cam member 36.

The roller 54 is urged into engagement with the cam surface 56 by a pair of tension springs 58. One end of each spring 58 is connected to the free end of one of the arms 60 of each bell crank 40 and the other end of each spring is anchored to the base member 30. The springs 58 tend to rotate the force-transmitting member, bell crank 40 in the illustrated embodiment about the pin 44 to urge the roller 54 into engagement with the cam surface 56.

As seen in FIG. 2 the springs 58 tend to rotate the bell cranks 40 in a clockwise direction about the axis of pin 44 relative to the arm members 28. The spring force therefore tends to urge the hood 12 from the illustrated position in a counterclockwise direction about the hinge pin 22.

Figure 6:
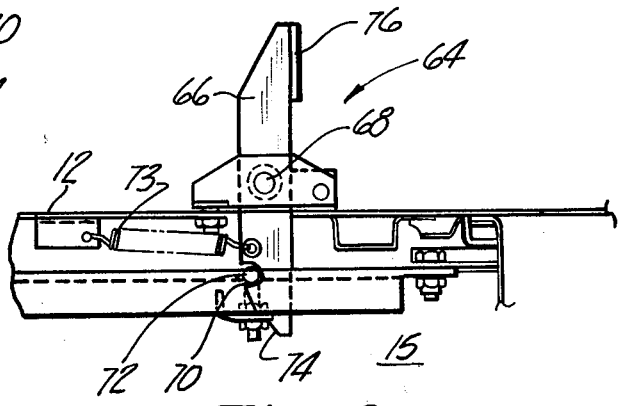
FIG. 6 is a side elevation of the hood latch assembly used to maintain the hood in a closed position.

The hood is maintained in its closed position by a latch assembly 64 including a latch member 66 pivoted relative to the hood 12 for movement about a latch pin 68. The lower end of the latch member 66 is provided with a recess 70 adapted to engage a lock pin 72 held in fixed relationship relative to the engine compartment 15. The latch member 66 is urged to a latched position in which the recess 70 receives the lock pin 72 by a spring 73 one end of which is anchored to the underside of hood 12 and the other end to the latch member 66 so that the latter is urged in a clockwise direction as viewed in FIG. 6. The lower end of the latch member 66 is provided with a beveled or cam surface 74 which acts to engage the pin 72 and moves the latch member 66 in a clockwise direction during closing movement of the hood 12.

Figure 4:
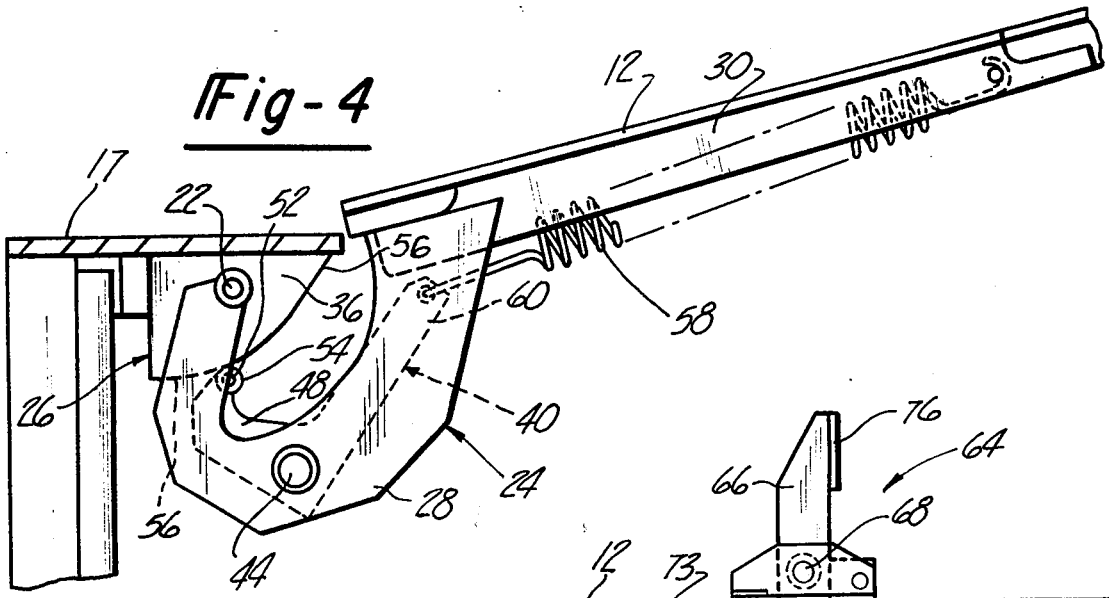
FIG. 4 is a side elevation similar to FIG. 2 but at an enlarged scale and showing the hood in a partially open position.

To release the latch assembly 64 the latch member 66 is rotated in a counterclockwise direction against the force of the spring 73 by exerting a manual force on the pad 76 located at the rearward edge of the hood 12. This moves the recess 70 of latch member 66 out of engagement with lock pin 72 to permit the springs 58 to rotate the force-transmitting member 40 in a clockwise direction as viewed in FIG. 2 relative to the arm members 28 and cause the hood 12 to move to an ajar or slightly open position as illustrated in dash lines in FIG. 1 or as shown in FIG. 4. Such movement is accomplished without the requirement for any additional physical effort on the part of a person opening the hood. Thereafter the hood 12 may be pivoted about its horizontal hinge axis 22 by the use of a small effort during which the hood 12 may be pivoted from its partially open position through a generally vertical position to a position at an angle where the hood rests against stops to prevent further rotation. In actual practice the initial opening of the hood without the assistance of any physical effort is for the first fifteen degrees of movement after which the hood may be rotated through an arc of an additional 120 degrees or a total of 135 degrees to its fully open position. The springs 58 apply a substantially uniform force to the force-transmitting member 40 during movement from the FIG. 4 to the FIG. 5 position. However, the profile of the cam member 36 as defined by the cam surface 56 is such that a varying force is applied to the hood 12 which is generally inversely proportional to the effort required to move the hood through its arcuate path. It will be understood, for example, that if the movement of the hood were not assisted, the effort required to open the hood would be large initially and decrease as the hood approached a generally vertical position in which its mass is in vertial balance. Movement beyond the vertically balanced position is assisted by the force of gravity until the hood reaches its fully open position seen in FIG. 5. The profile of the cam surface 56 is such that the uniform force of the springs 58 applied to the roller 54 against cam surface 56 results in a force inversely proportional to the effort that otherwise would be required to open the hood so that after initial opening movement under the effort of the springs alone, the hood 12 can be moved through its remaining arcuate path by applying a relatively uniform physical effort which in actual practice is maintained at a minimum. As the hood 12 moves beyond the vertically balanced position to the position seen in FIG. 5 the springs 58 act to resist opening movement to counteract the gravitational effect tending to open the hood. As the hood approaches its fully open position the roller 54 is at the end of the cam path defined by the surface 56 and against the underside of the cowl 17 which forms a stop limiting further movement of the hood.

It will be noted that the entire hinge assembly is concealed within the engine compartment and that the hinge or horizontal axis 22 is disposed beneath the cowl 17 and somewhat forwardly of the forward edge of the hood 12. The assembly 10 can be installed as a unit or the hood hinge subassembly 24 and compartment hinge subassembly 26 may be installed separately with the subsequent insertion of the hinge pin 22 since all of the components of the assembly 20 are mounted on either of the subassemblies without additional attachments for linkages or the like.

A hinge assembly for a vehicle hood has been provided in which separate members are pivoted relative to each other and attached to the hood and engine compartment respectively to counterbalance the hood and urge it to an initially open position and from the latter position to a fully open position through an arc greater than ninety degrees in such a manner that spring force alone tends to move the hood to its initially open position and subsequently the spring results in a force throughout the full range of arcuate movement of the hood which requires a constant minimum amount of effort on the part of a person to open the hood.

The embodiments of the invention in which an exclusive property or privilege is claimed are defined as follows:

1. A hinge assembly for a vehicle having an engine compartment with a hood opening and a hood for closing said opening, said hinge assembly including hinge members connected to said hood and said engine compartment, respectively, said members being pivotally connected to each other for swinging movement of said hood about a horizontal axis from a closed to an open position through an arc greater than 90 degrees, said compartment hinge member including cam means fixed relative to said axis, said hood hinge member pivoted on said axis and attached to said hood, a force-transmitting member pivoted relative to and mounted on said hood member at a point spaced from said axis and having guide means engaging said cam means, a tension spring supported on said hood member and exerting a substantially constant force for swinging said guide means into engagement with said cam means to counterbalance the weight of said hood and resulting in a net lifting force varying from a maximum value at opening to a substantially constant minimum after opening and to said fully open position.

2. The combination of claim 1 in which said cam means includes a member having a cam surface spaced from said horizontal pivot axis varying distances, said guide means being in engagement with said cam surface.

3. The combination of claim 1 in which said hinge assembly is concealed within said compartment when said hood is in said closed position.

4. The combination of claim 3 in which said horizontal pivot axis is disposed within said compartment and forwardly of the hinged edge of said hood.

5. The combination of claim 1 in which said force-transmitting member is a lever pivotally mounted on said hood hinge member for movement relative thereto.

6. The combination of claim 1 in which said guide means includes a member rotatably mounted on said force-transmitting member for rolling contact with said cam means.

7. The combination of claim 1 wherein said net lifting force is sufficient to move said hood to a partially open position without manual effort.

8. The combination of claim 5 in which said lever is a bell crank and said tension spring connected to said bell crank is thereby maintainable in a position generally parallel to and adjacent said hood throughout the total travel of hood swing from closed to fully open position.

* * * * *